US005975394A

United States Patent [19]

Shuval

[11] Patent Number: 5,975,394

[45] Date of Patent: Nov. 2, 1999

[54] PORTABLE BAG DISPENSER

[76] Inventor: Shlomo Shuval, 2124 Acton St., Berkeley, Calif. 94702

[21] Appl. No.: 09/072,345

[22] Filed: May 4, 1998

[51] Int. Cl.[6] ..... B26F 3/02

[52] U.S. Cl. ..... 225/106; 225/50; 225/78; 225/90

[58] Field of Search ..... 225/106, 93, 94, 225/96, 90, 78, 18, 16, 17, 53, 39

[56] References Cited

U.S. PATENT DOCUMENTS

| | | | |
|---|---|---|---|
| 405,412 | 6/1889 | Hicks | 225/106 |
| 1,122,673 | 12/1914 | Winter et al. | 225/106 |
| 3,291,299 | 12/1966 | Minnotte, Jr. | 225/106 |
| 4,088,276 | 5/1978 | Littleton | 225/78 |
| 4,606,485 | 8/1986 | Rankin | 225/78 |
| 4,738,385 | 4/1988 | Bell | 225/106 |
| 5,065,925 | 11/1991 | Ridenour | 225/78 |
| 5,135,134 | 8/1992 | Dancy | 225/53 |
| 5,630,526 | 5/1997 | Moody | 225/106 |
| 5,810,234 | 9/1998 | Burli | 225/106 |

*Primary Examiner*—M. Rachuba
*Assistant Examiner*—Sean A. Pryor
*Attorney, Agent, or Firm*—Linval B. Castle

[57] ABSTRACT

A portable hard cover dispenser for a small roll of interconnected plastic bags has a dispensing slot for removing a bag, a brake for holding the roll of bags while a bag is torn from the roll, a bag rewinder, and is equipped with a belt hook for convenience in carrying.

6 Claims, 1 Drawing Sheet

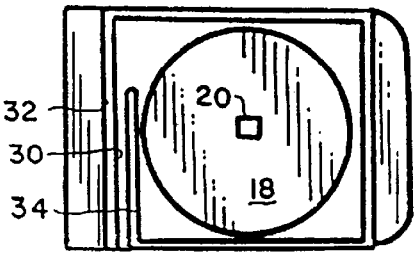
FIG. 2
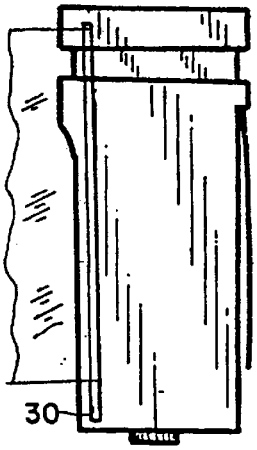
FIG. 3
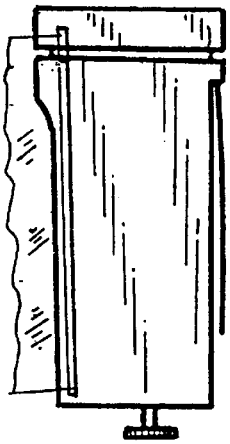
FIG. 4
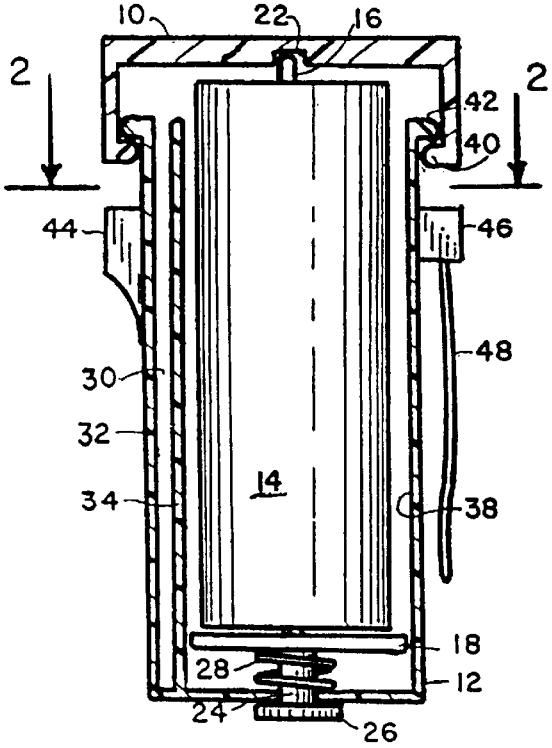
FIG. 1
FIG. 5
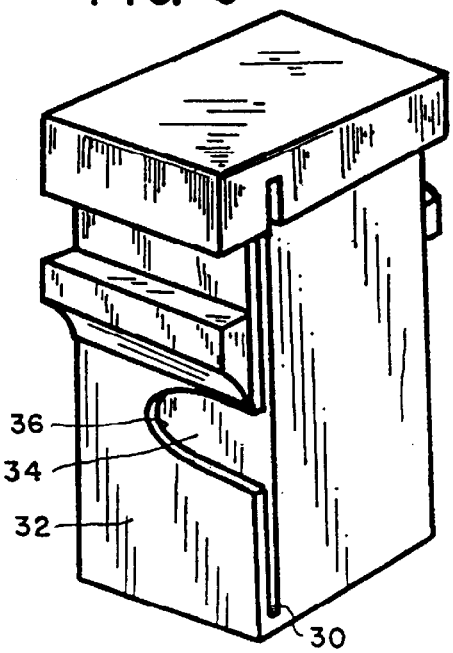
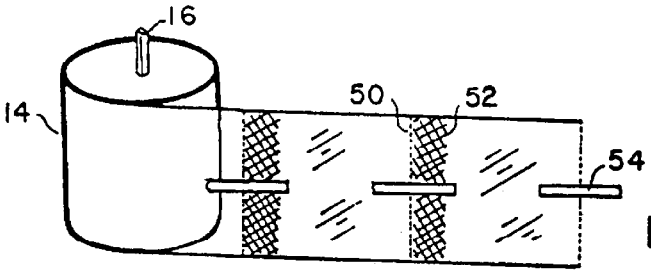
FIG. 6

PORTABLE BAG DISPENSER

This invention relates to bag dispensers and in particular to a small, portable, hard-cover dispenser that dispenses bags from a replaceable roll of interconnected plastic bags.

BRIEF SUMMARY OF THE INVENTION

A plastic bag is becoming a necessity for everyday living. It's use goes far beyond being a refrigerator food storage wrapping or a sandwich wrap for school lunches. Plastic bags are being carried in automobiles for small garbage items, in suitcases on trips for the isolation and storage of soiled laundry, in the stroller for the storage of clean as well as soiled diapers, and even police investigators carry them for carrying bits of evidence. Many cities have ordinances requiring their citizens to clean up any droppings left while walking their dog. This is best done with a plastic bag.

Plastic bags are therefore finding many uses outside of the home. In the home several different sizes of plastic bags may be conveniently stored in a drawer or on a shelf in the carton in which they were purchased. But carrying a carton of bags on a camping trip or while walking the dog will soon result in a broken carton and scattered bags. It would be much more convenient and more sanitary if a supply of plastic bags were carried in a small, hard covered box that is not crushable and could be hooked to a belt or knap sack or suspended by a hand strap.

The disclosed invention is for a small, hard plastic case for containing a roll of replaceable, interconnected, plastic bags which may be withdrawn one at a time. The case has a brake for locking the roll of bags to facilitate removal of one, and includes a rewinder for use in the event more than one bag is withdrawn. The case has a belt hook for ease in carrying.

BRIEF DESCRIPTION OF THE DRAWINGS

In the drawings which illustrate the preferred embodiment of the invention:

FIG. 1 is sectional elevational view of the portable plastic bag dispenser,

FIG. 2 is a sectional plan view taken along the lines 2—2 of FIG. 1;

FIG. 3 is an elevational view, in reduced size, illustrating a plastic bag being withdrawn from the dispenser;

FIG. 4 illustrates the dispenser of FIG. 3 with top depressed for removal of a bag;

FIG. 5 is a perspective view of the bag dispenser; and

FIG. 6 illustrates a preferred type of interconnected bags with the bag ends marked with printed bands and with attached closure wires.

DETAILED DESCRIPTION OF THE PREFERRED EMBODIMENT

The portable dispenser is for carrying and dispensing plastic bags from a roll of interconnected bags separated by a line of perforations. The preferred embodiment of the dispenser is made of hard plastic and, as shown in FIG. 1, has a cap 10 which latches to the plastic body 12 that contains a roll of the plastic bags 14. One wall of the body 12 is preferably of transparent plastic so that the roll of bags 14 may be viewed without removing the cap 10.

The roll of plastic bags 14 are on a center core 16 having a square cross section and are vertically placed on a disc shaped turntable 18 having a square center hole 20 to receive the core, as shown in FIG. 2. The roll of plastic bags and the turntable therefore turn together. A circular hole 22 is vertically aligned over the square hole 20 in the cap 10 and is formed only approximately half way through the cap in order to confine but not restrict the rotation of the square core 16.

The disc shaped turntable 18 upon which the roll of plastic bags 14 sits is axially attached to a shaft 24 that extends through the floor of the body 12 and is coupled to a rewinding knob 26. Between the floor of the body and the turntable is a fairly strong helical compression spring 28 surrounding the shaft 24. While the spring 28 is relaxed, as shown in FIG. 1, the turntable and the roll of plastic bags may rotate freely; however, when compressed by depressing the cap 10, there is considerable friction between the core 16 and the circular hole 22 in the cap, between the spring 28 and turntable 18 and between the spring and floor of the body 12, resulting in a braking action in the turntable rotation. Since the core 16 of the roll of bags is keyed to the turntable by the square hole in the surface of the turntable, such a braking permits a bag to be easily torn from the roll. If it is desired to roll some of the bags back into the dispenser, is only necessary to release the downward pressure on the cap and manually reverse the rotation of the turntable with the rewinding knob 26.

The bags are withdrawn from the dispenser through a vertical slot 30 in a sidewall and adjacent an end wall 32 of the body 12. Spaced from the interior surface of the end wall 32 approximately the ⅛ inch width of the slot 30 is an auxiliary wall 34 having a height approximately equal to that of the end wall 32 and about half as wide, as shown in the plan view of FIG. 2. The auxiliary wall 34 functions as a peeler or stripper blade for diverting the path of the connected bags from the roll to the slot 30 and also serves as a backboard for the bag withdrawal finger slot 36 formed in the end wall 32 as shown in the perspective view of FIG. 5.

Because the roll of bags 14 and the turntable 18 is raised by the helical spring 28 the vertical dispensing slot 30 must extend into the cap as shown in FIG. 3. Then, when the cap is depressed to apply braking pressure to the core of the bags, the turntable with the roll of bags is forced downward, as shown in FIG. 4, to shorten the exposed length of the slot 30.

The cap 10 loosely fits around the top of the body 12 but is latched to the body at the end walls 32, 38 by short inward-turned projections 40 depending from the cap that contact similar outward-turned projections 42 at the top of the end walls. To remove the cap for replacing a roll of bags, it is only necessary to squeeze together the cap guards 44, 46 on the end walls 32, 38. This will deflect the thin flexible material of the end walls and release the inward turned projections 40 from the projections on the cap. The cap guard 46 on the end wall 38 supports a belt hook 48 which may be slipped over a belt or a pocket for conveniently carrying the bag dispenser.

FIG. 6 illustrates a roll of plastic bags 14 wound on a square core 16. The bags are interconnected and are easily separable at perforations 50. Preceding each line of perforations is a lateral colored band 52 which provides a visual indication that the perforations have been reached. As an added convenience, a plastic coated tie wire 54 may be included with each bag; it may removeably adhere laterally to the bag behind the perforations or longitudinally lie across the perforations, as shown in FIG. 6, where it may also serve in assisting to withdraw a bag from the dispenser.

I claim:

1. A portable bag dispenser comprising:

a hollow body having walls and a floor connected to one end of said walls, said walls formed of thin flexible material, one of said walls having a long thin slot parallel to and adjacent a second wall for the passage of a bag therethrough;

a turntable in said body for supporting a roll of interconnected bags wound on a non-circular core, said turntable being axially supported above said floor of said body by a shaft extending through said floor to manual rewinding means, said turntable having an axial socket for receiving said non-circular core, spring means between said floor and said turntable for forcing said turntable from said floor; and a cap removably coupled to said body opposite said floor, said cap having central means for loosely confining said non-circular core for free rotation, said cap being moveable toward said floor for moving said non-circular core and said turntable against the force of said spring means.

2. The portable bag dispenser claimed in claim 1 wherein said second wall adjacent said long thin slot has a finger slot for the easy removal of an individual bag from said roll of bags said thin slot, said body having an auxiliary wall within said body and opposite said long thin slot for separating said bags from said roll.

3. The portable bag dispenser claimed in claim 1 further including a belt hook attached to said body for convenience in carrying said dispenser.

4. The portable bag dispenser claimed in claim 1 wherein at least one of said walls is transparent for viewing said roll of interconnected bags.

5. The portable bag dispenser claimed in claim 1 wherein said roll of bags are formed of a plurality of interconnected plastic bags separable at a lateral line of perforations, an end of each individual bag being marked with a visual indicator stripe.

6. The portable bag dispenser claimed in claim 5 wherein said roll of bags is wound on a central core having a square end, and the axial socket in said turntable is a square socket.

* * * * *